219-121 SR
9/24/85 XR 4,543,470

United States Patent [19]

Santén et al.

[11] Patent Number: 4,543,470

[45] Date of Patent: Sep. 24, 1985

[54] MEANS FOR ELECTRICALLY HEATING GASES

[75] Inventors: Sven Santén, Hofors; Palne Mogensen, Djursholm; Mats Kaij; Jan Thörnblom, both of Hofors, all of Sweden

[73] Assignee: SKF Steel Engineering AB, Sweden

[21] Appl. No.: 559,353

[22] Filed: Dec. 8, 1983

[30] Foreign Application Priority Data

Mar. 15, 1983 [SE] Sweden ..... 8301394
Jun. 29, 1983 [SE] Sweden ..... 8303706

[51] Int. Cl.[4] ..... H05B 7/18

[52] U.S. Cl. ..... 219/383; 219/121 P; 219/121 PQ; 373/18

[58] Field of Search ..... 219/383, 121 P, 121 PR, 219/121 PQ; 315/111.21; 373/18, 22

[56] References Cited

U.S. PATENT DOCUMENTS

| | | | |
|---|---|---|---|
| 2,770,708 | 11/1956 | Briggs | 219/121 P |
| 3,140,421 | 7/1964 | Spongberg | 219/121 PR |
| 3,360,988 | 1/1968 | Stine | 219/121 PR |
| 3,533,756 | 10/1970 | Houseman | 219/121 P |
| 3,832,519 | 8/1974 | Wolf | 219/121 P |
| 3,866,089 | 2/1975 | Hengartner | 219/121 P |
| 3,953,705 | 4/1976 | Painter | 219/121 P |

FOREIGN PATENT DOCUMENTS

| | | | |
|---|---|---|---|
| 532973 | 2/1977 | U.S.S.R. | 219/383 |

*Primary Examiner*—Roy N. Envall, Jr.
*Assistant Examiner*—Teresa J. Walberg
*Attorney, Agent, or Firm*—Allegretti, Newitt, Witcoff & McAndrews, Ltd.

[57] ABSTRACT

The invention relates to a means for electrically heating gases, comprising cylindrical electrodes (2,3) between which an electric arc (20) is generated. Between these two electrodes are arranged one or more spacers (6,7) whose length is from 100 to 500 mm.

20 Claims, 4 Drawing Figures

MEANS FOR ELECTRICALLY HEATING GASES

Figure 1:
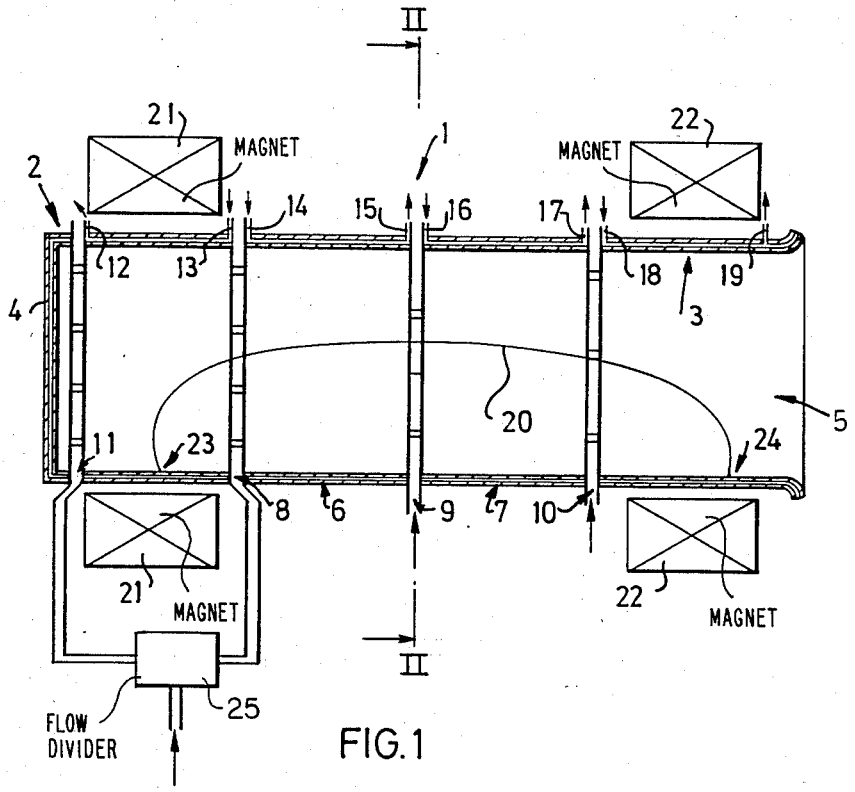

The present invention relates to a means for electrically heating gases, and more particularly to a plasma generator comprising cylindrical electrodes, one of which is closed at one end and the other open at both ends, said electrodes being connected to a current source to produce an electric arc between the electrodes, and arrangements for supplying gas to said means.

In industrial processes hot gases are used to transmit thermal energy and/or for participation in chemical reactions. The gas volumes are often extremely large, entailing high handling costs. Often the gas quantities could be greatly reduced provided sufficiently high enthalpy or energy density in the gas could be achieved.

One method of raising the energy content of a gas is to use a heat-exchanger. However, since the degree of efficiency for energy transmission to gases in heat-exchangers is low, this is not a very successful solution. Another method is to utilize combustion of fossile fuels, for instance, for direct heating of the gas. If the gas is to participate in a chemical reaction, however, combustion is often unsuitable for direct heating since the gas would become polluted and at the same time the composition would be altered. Certain chemical processes, but particularly metallurgical processes, require extremely high temperatures, i.e. in the vicinity of 1000°-3000° C. and/or the addition of vast quantities of energy under controlled oxygen potential. In such cases the processes should also be controllable by varying the quantity of gas and also by varying the enthalpy of the gas while maintaining the gas volume and with controlled oxygen potential. Under certain circumstances it is necessary to be able to control accurately the gas quantity, e.g. when the gas contains one or more of the reactants participating in a chemical reaction.

Numerous devices have been developed to satisfy all these requirements and it has been found that the use of an electric arc for plasma generation is an extremely useful technique.

Thus a plasma generator is already known from U.S. Pat. No. 3,301,995, which has two water-cooled cylindrical electrodes axially spaced from each other, one having a closed end and the other being open at both ends, a nozzle arranged near the open electrode, a water-cooled chamber with a diameter considerably larger than that of the electrodes and that of the gap between the electrodes, means in the wall of the chamber for injecting gas into the chamber, and a pipe with a nozzle to direct the gas flow to be heated in the chamber. Magnetic coils may also be arranged around the electrodes in order to achieve rotation of the arc roots.

Furthermore, U.S. Pat. No. 3,705,975 relates to a self-stabilizing alternating current plasma generator with a gap between two axially spaced electrodes, the gap being sufficiently narrow to permit the arc to be re-ignited every half period. In this plasma generator the arc is blown into the electrode chamber and cooperates there with the gas to be heated. A partition is arranged between the electrodes, and channels arranged in this partition are designed to give the gas high angular speed as well as an axial speed component which blows the arc into the reaction chamber.

U.S. Pat. No. 3,360,988 relates to a plasma generator design with segmented, limited passage between anode and cathode.

The arc chamber could be characterised as a supersonic nozzle, making the arrangement suitable for heating a wind tunnel, an arc cathode upstream from the nozzle; and an anode downstream from the nozzle, constructed from electrically conducting segments, insulated from each other, forming a circular configuration, the nozzle forming an elongate, narrow passage with uniform diameter through which the arc must pass.

However, the types of plasma generator described above have certain limitations and drawbacks.

The use of two electrodes separated by a gas inlet means that the arc length, and thus the voltage, are determined by the gas flow. With constant current, the gas flow must be increased in order to increase the voltage and thus the output, and the enthalpy of the gas leaving is thus reduced.

At normal over-pressure, i.e. 1-10 bar, the voltage will be relatively low, of the order of 1000 volt. The only way of increasing the output, therefore is to increase the current strength. However, this results in shorter service life for the electrode.

With segmented channels, i.e. where insulating plates are alternated with electrode plates, the voltage possible is limited, and thus also is the output, since the flow of the cold gas layer along the wall is disturbed and the arc will therefore strike down too early. There is also a risk that instead of passing centrally in the channel, the arc chooses to jump over the relatively thin insulating plates between the electrode plates.

Plasma generators known hitherto are primarily intended for laboratory use and are not so suitable for industrial use because of their complicated construction. This applies particularly to the segmented types of plasma generators which require a vast number of connections for coolant, gas supply etc.

The object of the present invention, therefore, is to achieve a plasma generator permitting high power output, having long electrode life, high efficiency and with a simple and reliable design feasible for industrial use.

Accordingly, the present invention provides neans for electrically heating gases, in the form of: a plasma generator comprising cylindrical electrodes, one of which is closed at one end and the other open at both ends, said electrodes being connected to a current source to produce an electric arc between the electrodes; at least one spacer arranged between the electrodes, the or each spacer having a length of 100 to 500 mm; and means to supply gas to said heating means.

Preferably, there are two end modules, each including a respective said electrode with connections for electricity, gas and coolant, and there are also intermediate modules each comprising a spacer with coolant and gas connections which are preferably quick release couplings, and having means for attaching such intermediate modules to each other and to each end module. The operating characteristic of the plasma generator can thus easily and conveniently be adjusted to requirements by the removal or addition of one or more of said internediate spacers.

By arranging the gas supply gap(s) so that the gas is caused to rotate during its passage therethrough, the arc is stabilized. The rotating gas flow, combined with cold walls, gives a centered, stable arc with little intermixing and thus high temperature. This entails certain drawbacks in the form of low voltage drop and high radiation losses.

According to a further embodiment of the invention the means is designed with stepwise increasing diameter, seen in the main direction of the gas flow. At least one diameter step is thus arranged and the ratio between the diameter before and after the step shall be from about 0.5 to 1, preferably from about 0.7 to 0.9.

The diameter-increasing step causes the rotation centre of the gas to follow a spiral path so that surrounding gas is mixed into the arc making it cooler. At constant current and gas flow this will result in increased voltage of the arc, with substantially the same degree of efficiency, or the means can thus be made more compact while retaining the same output.

According to an alternative embodiment an electromagnet or equivalent is arranged at a point along the path of the arc, to generate a magnetic field operating at right angles to the arc. This will cause the arc to be moved for at least a short distance, from the geometric centre line of the passage, giving a similar effect to that obtained in the arrangement with a diameter-increasing step.

Both these embodiments require long spacers to be used to obtain undisturbed flow and thus increase the arc voltage while retaining a high degree of efficiency.

Figure 2:
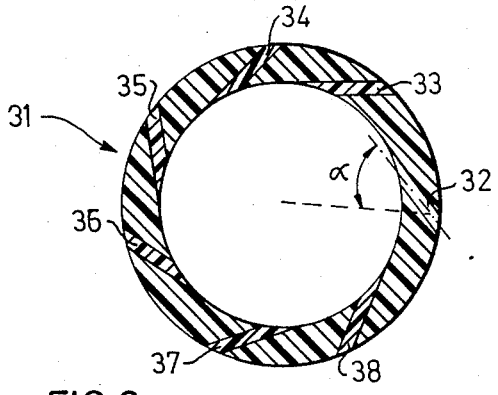
Figure 3:
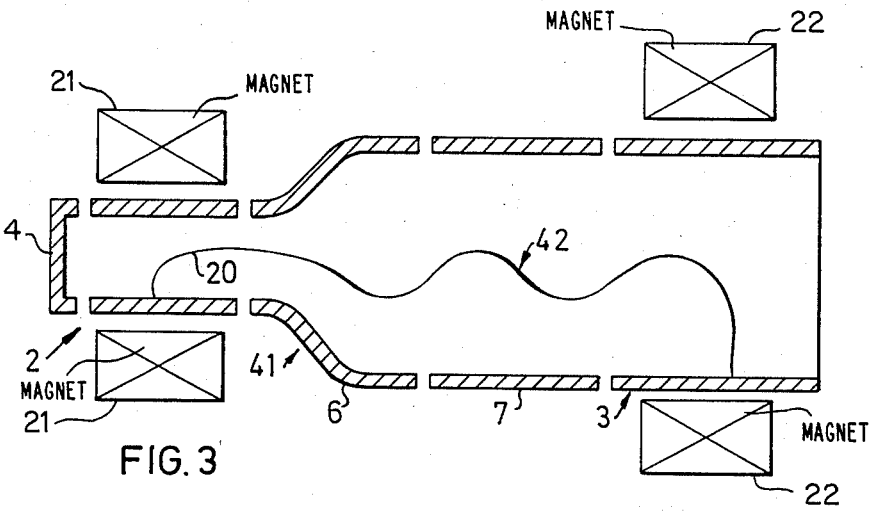
Figure 4:
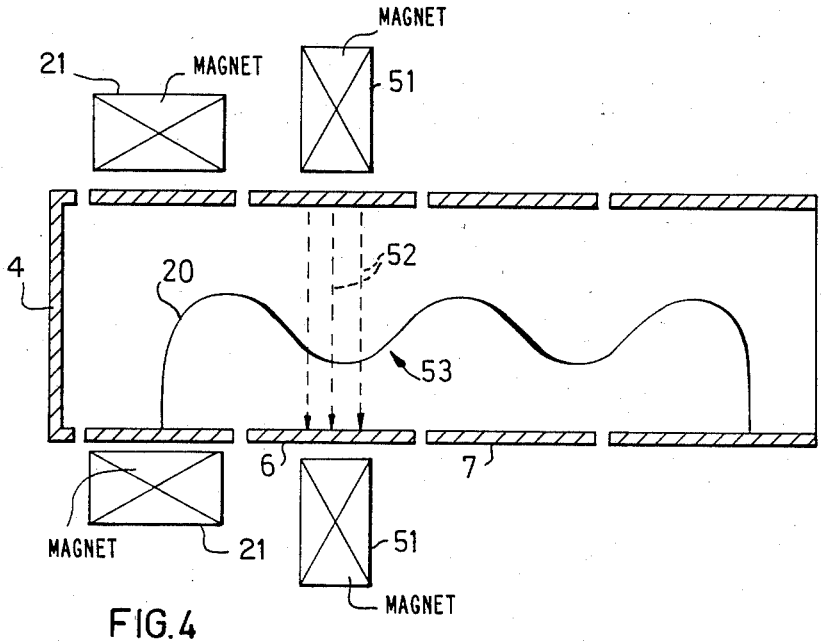

Further advantages and charcteristics of the invention will be revealed in the following detailed description with reference to the accompanying drawings in which FIG. 1 schematically shows an embodiment of the gas heating means according to the invention, FIG. 2 schematically shows a cross section through a gas-supply gap, taken along the line II—II in the embodiment according to FIG. 1, FIG. 3 schematically shows a second embodiment of the invention with a diameter step, and FIG. 4 schematically shows a third embodiment of the invention with a magnetic coil to generate a transverse magnetic field.

FIG. 1 thus shows schematically one embodiment according to the invention for electrically heating gases. The means, designated 1, comprises two cylindrical electrodes 2 and 3, the first having a closed, free end 4 and the second having an open free end 5, and tubular spacers 6 and 7 arranged between the electrodes. In the embodiment shown there are two spacers. However, both the number and length of the spacers can be varied as explained below.

The gas-supply gaps 8, 9 and 10 are arranged between each electrode and adjacent spacer and between the spacers. Furthermore, in this embodiment a gas-supply gap 11 is arranged near the closed end of the first electrode.

Both electrodes and spacers are water-cooled, as indicated by inlet and outlet unions 12, 13; 14, 15; 16, 17 and 18, 19 for water. Both electrodes and spacers are preferably made of copper or copper alloy.

The electrodes are connected to a current source, not shown in detail, to generate and electric arc 20 between the two electrodes. The electrodes 2 and 3 are surrounded by a magnetic field coil or permanent magnet 21 and 22, respectively, for generating a magnetic field with which the arc roots 23 and 24, respectively, are caused to rotate.

Most of the gas to be heated is introduced between the upstream electrode 2 and the adjacent spacer 6. Arranging this gas inlet so that the gas flow is given an initial leftward speed component, i.e. opposed to the main direction of flow, enables the location of the arc roots to be displaced longitudinally by "blowing". Some of this main gas flow can be separated and introduced through the gas-supply gap 11 near the closed end of said electrode. The gap 11 is preferably designed so that the gas flows essentially rightwardly, i.e. in the main direction of flow. By also arranging a flow divider 25 or some other flow-control mechanism in conjunction with the two gas inlets 8, 11, the proportion of the gas flow introduced through the gas inlet 11 at the closed end 4 may varied progressively between extreme limits when all of the gas passes through one inlet and none through the other. This further reduces wear on the electrodes since the arc roots can be moved to and fro. This "blowing effect" can also be utilized to vary the length of the arc and thus achieve a certain power variation in the arc.

The gas flowing in through gas-supply gaps 8, 9, 10 between the spacers and between the downstream spacer and the open electrode is intended to prevent the arc from striking down too early. The entering gas thus acquires a tangential speed component and preferably also an axial speed component. The width of the gap should preferably be 0.5 to 5 mm. A cooler, rotating gas layer is thus obtained along the inner walls of the electrodes and spacers, said cooler layer surrounding the arc which runs substantially centrally in the cylindrical space. To produce this cooler gas layer, gas is blown in through the gas inlets along the path of the arc.

When the gas flow approaches the outlet of the downstream electrode, the other root of the arc will come into contact with the electrode wall. The mean temperature in the gas flowing out may vary from 2000° to 10.000° C., depending on the arc output and the quantity of gas flowing out per unit time.

As shown in FIG. 2, a gas-supply gap can be produced by means of an annular disc 31 with grooves 32–38 distributed around its periphery to form a number of gas-supply openings. The grooves shall be dimensioned so that the outflow angle $\alpha$ in relation to the radius is greater than 0°, preferably from 35° to 90°.

The cross-sectional area of the grooves shall be designed to give an inflow speed of at least 50 m/s.

It is surprising that the arrangement of a few gas inlets relatively far from each other along the path of the arc can prevent the arc from striking down too early. It is also surprising that this can be exploited to prevent the arc from choosing a different path, i.e. through the spacer body; it just "jumps" over the gas-supply gaps.

It has been found experimentally that the heat loss per unit length increases along the spacers because the protective effect of the cool gas layer decreases with the distance from the gas inlet, since the gas rotation becomes less and heating therefore occurs more quickly.

FIG. 3 shows a modified embodiment of the arrangement according to the invention, the parts which remain the same being given the same designations as in FIG. 1. A diameter-increase is shown at 41, in this embodiment in the first spacer. Additional diameter-increases may be arranged thereafter. The actual diameter-increase at 41 may be of varying steepness and in the embodiment shown it is in the form of a truncated cone, the cone angle being selected to give substantially smooth flow. The ratio between the diameter before and after the step is 0.5 to 1. The diameter-increase will cause the centre of rotation of the gas to describe an essentially spiral path, and the arc will therefore also pass cooler gas as indicated at 42 in the drawing.

FIG. 4 shows the third embodiment of the invention, differing from that shown in FIG. 1 only in that an electro-magnet 51 or equivalent is arranged so that the magnetic field produced, indicated by lines 52, acts on a part of the arc. In fact, as the magnet has been arranged in the drawing, the magnetic field 52 will influence the arc to deflect in a direction out of the plane of the paper at the same time as it is given a helical movement, indicated at 53, by the rotating gas.

To further illustrate the invention a number of different experiments will be described in the following.

Example I

Measurements were performed on a spacer 200 mm long in a means according to the invention. The water cooling was divided into four separate units, each cooling 50 mm of the element in question. It was found that the coolant temperature increase in each of the four segments was 3.8°, 3.9°, 4.2° and 5.3° C., respectively. As can be seen, a considerable temperature increase is obtained, considering that the water flows past the spacer in a gap about 0.1 mm wide. The water thus flows past the segment at extremely high speed.

Example II

Under the same conditions as in Experiment I, but with 20% higher gas flow, the following temperature increases were obtained: 3.8°, 3.9°, 4.1° and 4.8° C.

It is clear from these experiments that the gas flow has great influence on the heat loss to the spacers and also that a 10% improvement in efficiency is achieved by increasing the gas flow by about 20% in the gas-supply gaps arranged along the means.

Thus, according to the invention, a means for electrically heating gas can be constructed with fixed arc length and with long spacers, since an insulating gas layer can be obtained over the entire length of the means, which greatly reduces heat losses to the electrode and spacer walls.

By constructing the spacers as modules with quick couplings for gas and water in accordance with the preferred embodiment, the means can easily be adapted for various power requirements. To further illustrate this, a rough explanation is given below of how the voltage drop affects the length of the gas heating means.

The voltage drop in the means is dependent on a number of different factors, such as gas composition, gas quantity, and gas enthalpy. However, for most applications it will be in the vicinity of 15 to 25 volt/cm.

Mainly to keep the electrode wear down, the current strength should preferably not exceed 2000 A.

With the above limitations, arc lengths of 1 to 1.6 m and 2.5 to 3 m, respectively, were obtained for a total power of 5 and 10 MW, respectively.

The electrodes are usually 200 to 400 mm long and by designing the spacers of suitable length and as modules, the total power can be varied in suitable steps.

Each spacer shall be 100 to 500 mm in length, preferably 200 to 400 mm.

Example III

Two different plasma generators were used for the experiment, but under uniform conditions, the only difference between the generators being that one has a diameter-increasing step with a ratio of $D_{before}/D_{after}$ of 0.73, whereas the other had uniform diameter along the entire passage length.

In a first series of experiments with a gas flow of 500 $m^3$ per hour and current strength of 1700 ampere, a voltage of 1630 volt was obtained in the plasma generator without step and 1820 volt in the plasma generator with step.

In a second series of experiments with a gas flow of 486 $m^3$ an hour and a current strength of 1500 ampere, a voltage of 1680 and 1850 volts, respectively, was obtained.

Example IV

Several experiments were performed with a plasma generator having a coil pair (51) to generate a magnetic field across the path of the arc, besides the magnetic field used to rotate the arc roots (FIG. 1). The table below shows the voltages obtained for various current strengths through the magnetic coil.

The gas flow through the plasma generator was 905 $m^3$ an hour and the current strength was 1800 ampere.

TABLE

| $I_{magnetic\ coil}$ (A) | $U_{plasma\ generator}$ (kV) | improvement in efficiency (%) |
|---|---|---|
| 0 | 2.1 | — |
| 100 | 2.16 | 0.4 |
| 200 | 2.25 | 1.0 |
| 300 | 2.32 | 1.4 |

It is clear from Examples III and IV above that while retaining the output of the generators these can be made much more compact. This is of great significance to their industrial application. Naturally the embodiments with magnetic field and diameter-increasing steps can be combined. The current consumed in the additional magnetic coil 51 constitutes only a fraction of the total power and may therefore be neglected in calculating power consumption.

It should be noted that in the embodiment with transverse magnetic field, the application of a magnetic field increases both the efficiency and the enthalpy of the gas leaving. This is very surprising since in conventional methods an increased enthalpy in the gas has meant having to accept a lower degree of efficiency.

Thus, with the method according to the invention, plasma generators can be constructed for extremely high effects while still remaining manageable. A uniform temperature distribution can also be obtained while still retaining a cold layer along the wall. In conventional plasma generators an extremely hot arc is obtained initially and the cold layer along the wall has been extensive, but has disappeared very rapidly due to radiation losses and uneven flow.

From the construction point of view the means according to the invention is simple, with few elements and relatively few connections. It is therefore extremely reliable in operation. Even if as many as five spacers are used, they are each so long that the flow picture remains relatively undisturbed along the length of the means.

We claim:

1. In gas heating means for electrically heating gases having (a) a plasma generator comprising first and second cylindrical electrodes, said first cylindrical electrode having an open end and a closed end and said second cylindrical electrode having two open ends; and (b) supply means to supply gas to be heated, said gas generally flowing in a main direction from said first electrode toward said second electrode, the improvement comprising:

at least one spacer arranged between said first and second electrodes, said spacer defining a length disposed between said first and second electrodes and said length being 100 to 500 mm; and a first gas supply gap, between said first electrode and an adjacent spacer, for causing the gas to flow initially in a direction opposite to said main direction of gas flow through said gas heating means, whereby an arc may emerge from said first electrode at an upstream arc root, follow an arc passage through said spacer, and contact said second electrode at a downstream root, and whereby said upstream root of the arc is moved against the main direction of gas flow, toward the closed electrode end.

2. Gas heating means according to claim 1, wherein a further gas supply gap is arranged close to the closed end of said first electrode and said gas heating means further comprises flow divider means for controlling the relative amount of gas supplied through (1) said further gas supply gap and (2) said first gas supply gap between said first electrode and an adjacent spacer, whereby the location of the upstream root of the arc may vary in a longitudinal direction along the gas heating means.

3. Gas heating means according to claim 1 wherein said gas supply gap defines a width between said first electrode and adjacent spacer and said width is from 0.5 to 5 mm.

4. Gas heating means according to claim 1 wherein said gas heating means includes five of said spacers.

5. Gas heating means according to claim 4, wherein its output is substantially equal to 10 MW and its length is substantially equal to 2 m.

6. Gas heating means according to claim 1 wherein said electrodes and spacer are each a conductor selected from the group comprising copper and copper alloy.

7. Gas heating means according to claim 1, wherein said one spacer defines a length disposed between said first and second electrodes and wherein the length of said spacer is from 200 to 400 mm.

8. Gas heating means according to claim 1, wherein the gas supply gaps are so designed that the gas is caused to rotate during its passage through the electrodes and the spacer.

9. Gas heating means according to claim 8, wherein said gas heating means includes an interior, said gas supply gap includes an annular disc of a predetermined radius, and the gas is caussed to flow in to said interior of said gas heating means at an angle greater than 0° relative to said predetermined radius.

10. Gas heating means according to claim 9, wherein said angle is from 35° to 90° relative to said predetermined radius.

11. Gas heating means according to claim 1, wherein the electrodes and each spacer include water cooling channels.

12. Gas heating means according to claim 1, wherein its output is substantially equal to 10 MW.

13. Gas heating means according to claim 1, including magnetic field coils arranged near the electrodes to produce a magnetic field, thus causing said upstream and downstream roots of the arc to rotate.

14. Gas heating means according to claim 1, including permanent magnets arranged near the electrodes and having their magnetic fields arranged to cause said upstream and downstream roots of the arc to rotate.

15. Gas heating means according to claim 1, wherein it is constructed of:

(a) two end modules, each including one of said electrodes; and (b) at least two intermediate modules, each comprising one of said spacers.

16. Gas heating means according to claim 1, wherein said arc passage undergoes at least one diameter increase along said main direction of the gas flow through the gas heating means.

17. Gas heating means according to claim 16 wherein the diameter after the increase is from one to two times larger than the diameter before the increase.

18. Gas heating means according to claim 17 wherein the diameter after the increase is from 1.1 to 1.4 times larger than the diameter before the increase.

19. Gas heating means according to claim 1, including means to generate a magnetic field at a point along said arc passage operating at right angles to the arc.

20. Gas heating means according to claim 19, wherein said means to generate a magnetic field is an electromagnet.

* * * * *